US005641089A

United States Patent [19]

Palank

[11] Patent Number: 5,641,089

[45] Date of Patent: Jun. 24, 1997

[54] APPARATUS AND METHOD FOR COVERING AND PROTECTING THE GROOVE OF A PAINT CAN

[76] Inventor: Fred J. Palank, 9759 Arrowsmith South, Seattle, Wash. 98118

[21] Appl. No.: 537,550

[22] Filed: Oct. 2, 1995

Related U.S. Application Data

[63] Continuation of Ser. No. 182,765, Jan. 14, 1994, abandoned.

[51] Int. Cl.[6] ..... B65D 25/34

[52] U.S. Cl. ..... 220/733; 220/701; 220/806

[58] Field of Search ..... 220/354, 356, 220/357, 378, 695, 698, 699, 700, 701, 733, 729

[56] References Cited

U.S. PATENT DOCUMENTS

| | | | |
|---|---|---|---|
| 2,756,899 | 7/1956 | Crandall | 220/698 X |
| 2,873,052 | 2/1959 | Atherton | 220/695 X |
| 2,885,108 | 5/1959 | Donoghue | 220/378 X |
| 2,903,154 | 9/1959 | Hendershot | 220/698 X |
| 2,910,209 | 10/1959 | Nelson | 220/378 |
| 2,960,257 | 11/1960 | Sasse | 220/354 X |
| 3,366,272 | 1/1968 | Ballmann | 220/698 |
| 3,469,735 | 9/1969 | Burt | 220/698 |
| 3,603,485 | 9/1971 | Vivier | 222/129 |
| 3,712,519 | 1/1973 | Collie | 222/563 |
| 3,811,606 | 5/1974 | Higgins | 222/570 |
| 3,894,650 | 7/1975 | Crump . | |
| 3,899,107 | 8/1975 | Gaal | 220/701 X |
| 3,902,630 | 9/1975 | Knize | 220/319 |
| 3,913,785 | 10/1975 | Pattershall | 220/354 |
| 3,980,213 | 9/1976 | Ramsay | 222/485 |
| 4,009,802 | 3/1977 | Hayduchok | 222/108 |
| 4,014,465 | 3/1977 | Ritter | 222/563 |
| 4,125,210 | 11/1978 | Embree | 222/570 |
| 4,203,537 | 5/1980 | McAlister | 222/570 |
| 4,225,064 | 9/1980 | Westcott | 222/569 |
| 4,369,890 | 1/1983 | Bennett . | |
| 4,832,293 | 5/1989 | Gizzi | 248/110 |
| 4,893,723 | 1/1990 | Seabolt . | |
| 4,907,714 | 3/1990 | Gatz . | |
| 4,911,319 | 3/1990 | DeJean . | |
| 5,012,960 | 5/1991 | Arnold | 222/570 |

*Primary Examiner*—Stephen J. Castellano
*Attorney, Agent, or Firm*—Donna J. Thies

[57] ABSTRACT

A paint can groove cover. The paint can groove cover comprises a generally annular ring having a top portion and a side portion. The upper surface of the top portion of the annular ring is sloped downwardly in the first and simplest embodiment. In the first embodiment of the paint can groove cover a generally flat lower surface of the top portion allows the cover to be stored on top of a resealed paint can. In the first embodiment there is a gap between the lower surface of the groove cover and the upper surface of the top groove portion of a paint can. The second embodiment slopes the lower surface of the top portion of the groove cover to eliminate this gap. A third embodiment has the generally flat lower surface of the top portion and provides a presser integral with the lower surface of the top portion for pressing a gasket into the full length of the annular path of the paint can groove. The gasket thus seals the gap and paint may be poured from the can with the groove cover and gasket in place or with the groove cover removed and the gasket in place. A fourth embodiment provides the same presser and a gasket that is pressed into the paint can groove for substantially one-half the circumference of the paint can groove with paint being poured across the area of the cover that has the gasket in place. In all four embodiments, paint may be poured from the can with the groove cover in place with minimal or no paint seeping into the groove.

14 Claims, 8 Drawing Sheets

APPARATUS AND METHOD FOR COVERING AND PROTECTING THE GROOVE OF A PAINT CAN

This application is a continuation of application Ser. No. 08/182,765, filed Jan. 14, 1994 now abandoned.

BACKGROUND OF THE INVENTION

This invention relates generally to a paint can lid cover and groove protector and more specifically to a new and improved paint can lid cover and groove protector which is simple and inexpensive in its manufacture and operation and easily allows the pouring of paint from the can without removing the groove protector from the paint can and without an elaborate pour spout.

Painting with a brush dipped directly into the paint can and then wiping the brush against the side of the can or pouring paint from the can can result in messy paint drippings down the side of the can and, more importantly, can result in the groove portion at the top of the can becoming filled with paint. If the groove is filled with paint, the paint will splatter when the can lid is replaced causing paint to drip down the sides of the can and onto whatever surface the can sets. Also, it is now considered environmentally unsound to throw out partially filled paint cans so that it is desirable to use all the paint in the can if possible. In addition, if the paint is purchased for touch-up purposes, it is desirable to store the paint for long periods of time between touch-ups. When dried in the groove, the paint diminishes the integrity of the groove, thereby making it difficult to secure a tight seal with the lid, thereby causing the remaining contents in the can to dry up and be unsuited for long term storage. Also, if the lid is replaced with paint in the groove, the lid may stick to the wet paint, thereby making it difficult or impossible to re-open the can for the next use.

It is well known in the painting field that it is desirable to protect the groove in the top of the paint can so that the lid of the can will be securely replaced after use thereby eliminating mess and preserving the contents of the paint can for long periods of time. There are a number of prior art patents which seek to accomplish this end with a cover that is expensive and complicated in use and manufacture and which is very elaborate in design. In order to allow the user to dip the brush directly into the can there have been provided by prior art covers, a number of configurations, usually with some kind of slot requiring a good aim and patience to dip the brush in the can while the cover is engaged. In an attempt to allow the user to pour paint from the can with the cover in place there have been provided a number of elaborate and complicated pouring spouts on the cover. Such covers are very expensive to tool and necessarily very expensive to the consumer and in some cases even require some minimal training to use. Also, with a pour spout as part of the groove cover it is difficult to store the groove cover on top of a resealed can of paint so it will be readily available for its next use.

Prior to the following search a Disclosure Document was filed with the U.S. Patent and Trademark Office Reference Number 310806 having a receipt date of Jun. 1, 1992.

U.S. Pat. No. 3,603,485 to Vivier discloses a container with two chambers for mixing together two products at the time of use.

U.S. Pat. No. 3,712,519 to Collie teaches a plastic container having a snap on and off lid with a pouring spout.

U.S. Pat. No. 3,811,606 to Higgins describes a cover with lower inner and outer peripheral portions that have inwardly directed circumferential portions for snap engagement over the usual inner and outer rim beads of the can rim.

U.S. Pat. No. 3,894,650 to Crump discloses a paint can ring with furrows which mate with the grooves on a paint can rim. There is also a tab for removal and a slit for squeegeeing a stirrer stick.

U.S. Pat. No. 3,913,785 to Pattershall teaches a groove cover which can be retained for storage on either end of the paint can. This cover has a annular lid retaining flange to engage the outside of the can. Since the downwardly sloping annular band does not have an extension into the inside of the can, paint cannot be poured from the can with this cover in place.

U.S. Pat. No. 3,980,213 to Ramsay discloses a cover which engages the rim of the top of the paint can and has a brush opening with a straight edge and a pouring opening.

U.S. Pat. No. 4,009,802 to Hayduchok discloses a brush scraping means with a shallow cavity for catching and retaining paint drippings.

U.S. Pat. No. 4,014,465 to Ritter describes a pour spout and paint brush wiper whereby the paint brush can be wet without removing the pour spout.

U.S. Pat. No. 4,125,210 to Embree discloses an annular collar for snap fit engagement with the rim of a paint can, a brush rest portion extends in one direction and a pour spout in the other direction.

U.S. Pat. No. 4,203,537 to McAlister discloses an annular ring with a pouring spout. The spout is extended to double as a brush resting surface.

U.S. Pat. No. 4,225,064 to Westcott discloses a cover with a pouring lip and a service lip for scraping a paint brush.

U.S. Pat. No. 4,369,890 to Bennett discloses a paint can collar with a lower lip portion for engagement with the rim, an intermediate portion rests on the top of the paint can, and an upper lip portion to return paint to the can.

U.S. Pat. No. 4,832,293 to Gizzi teaches a cover which attaches to an opened paint can for holding a brush and provides a balanced lifting handle free of paint.

U.S. Pat. No. 4,893,723 to Seabolt discloses a paint can attachment with a seal that mates with the rim of the container, a pour spout with a cap, an access opening, a paint paddle scraper and a comb for cleaning brushes.

U.S. Pat. No. 4,907,714 to Gatz discloses a resilient paint can cover which stretches to engage the inner lip of the paint can.

U.S. Pat. No. 4,911,319 to DeJean discloses a paint can attachment which fits into the rim channel around the open top of a paint can and is attached to the can by downwardly extending protuberances which are frictionally fit into the rim channel.

U.S. Pat. No. 5,012,960 to Arnold discloses a groove protector and spout with guards on the top for pouring so as not to have outwardly projecting spouts.

SUMMARY OF THE INVENTION

In order to overcome problems hereinbefore described there has been devised by the present invention an easy and inexpensive to use paint can groove cover that is easily snapped into place, used over an opened paint can to protect the paint can groove, allows for the dipping of the paint brush into the can and allows for the pouring of paint from the can while in use without a pour spout of any kind being added to the device. Because of its generally flat lower surface, the paint can groove cover of the present invention is also easily stored on top of a resealed paint can so that it is readily available for its next use. This flat lower surface presents a gap between the lower surface of the top portion of the device and the sloping upper rim of the paint can. In a second embodiment of the present invention the lower surface of the device is sloped to complement the slope of the upper rim of the paint can to effectively seal the gap. In all embodiments of the present invention an elongated side portion is provided which extends longitudinally down the side of the paint can generally to the area of the paint can having the stud which holds the handle for carrying the paint can. The elongated side portion prevents paint from getting under the groove cover as would occur with a short snap-on side portion that would snap-on to the outer rim of the paint can, and generally strengthens the groove cover also since the longer side portion would not easily break or crack like a short snap-on side portion would.

To maintain the generally flat lower surface on the device for easy storage onto a resealed paint can and to seal the gap between the lower surface of the top portion of the device and the upper rim of the paint can, a sealing means is provided. In most instances, particularly while pouring thinner liquids such as wood stain, the generally flat lower surface of the annular ring of the present invention keeps liquids from seeping into the paint can groove. Also, with thicker liquids such as paints, the generally flat annular ring of the present invention is usually sufficient to keep paint out of the paint can groove when pouring paint with the groove cover of the present invention engaged. To further insure that heavier liquids such as paint do not seep into the paint can groove when paint is being poured, with the present device in place, there has been provided by the present invention a third embodiment which includes an annular ridge which is integral with the lower surface of the top portion of the annular ring. This annular ridge forms a pressing means for insertion of a gasket into the path of the paint can groove on the top of the paint can, which can either be inserted around the entire path of the groove as in a third embodiment of the invention, or around a partial portion of the path of the groove as in a fourth embodiment of the invention. The gasket, either in total or partial position within the path, serves to further ensure that heavier liquids will not seep into the paint can groove. If the gasket is inserted into the entire path of the paint can groove under the top portion of the annular ring, paint can still he easily poured out of the can with the present paint can groove cover in place. If the gasket is inserted into substantially half of the entire path of the paint can groove under the top portion of the annular ring, paint is poured out of the can across the portion of the groove cover which has the gasket in position. The groove cover can also he removed with the partial or whole gasket remaining in place and paint is then poured out of the can across the area with the gasket in place to protect the groove.

It is therefore an object and advantage of the present paint can groove cover to provide a groove cover that is simple and inexpensive to manufacture.

It is another object of the present invention to provide a paint can groove cover that is simple and inexpensive to use.

It is yet another object of the present invention to provide a paint can groove cover that allows the pouring of paint from the paint can without an additional pouring spout of any kind.

It is still yet another object and advantage of the present invention to provide a paint can groove cover with an elongated side portion for preventing paint from getting under the groove cover from the side of the paint can, and to strengthen the groove cover.

It is still yet another object and advantage of the present invention to provide a paint can groove cover that allows the use of paint directly from the can by dipping a brush into the can with the groove cover in place so that the brush does not have to be inserted into a small slot.

It is still yet another object of the present invention to provide a groove cover that allows the simultaneous protection of the paint can groove with pouring paint from the can or with dipping the brush into the can, in both instances of using thin or thick liquids such as stains or paint.

It is still yet another object and advantage of the present invention to provide a groove cover that is easily stored on top of a resealed paint can so that it is readily available for its next use and does not take up additional space wherever paint cans are stored.

DESCRIPTION OF THE PREFERRED EMBODIMENTS

Figure 1:
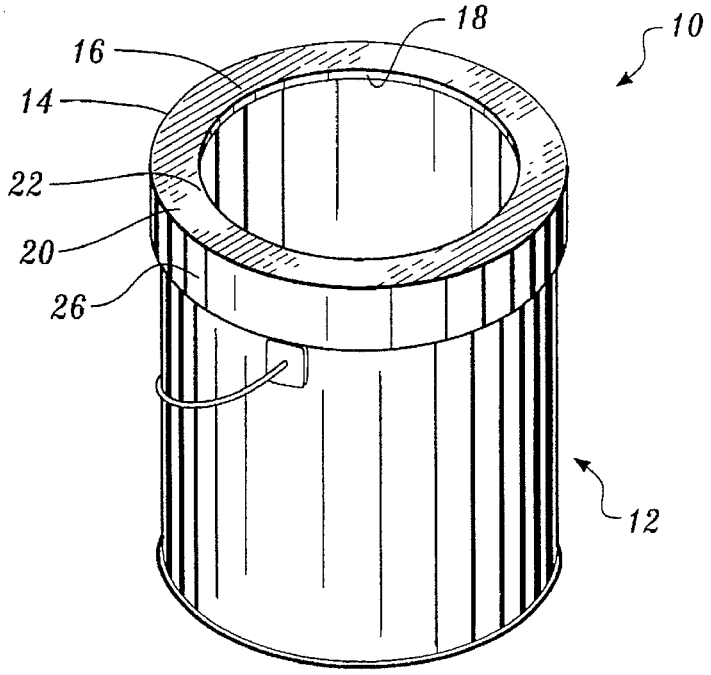
FIG. 1 is a perspective view of the present paint can groove cover shown as it is positioned on top of a resealable paint can after the existing paint can lid has been removed.
Figure 6A:
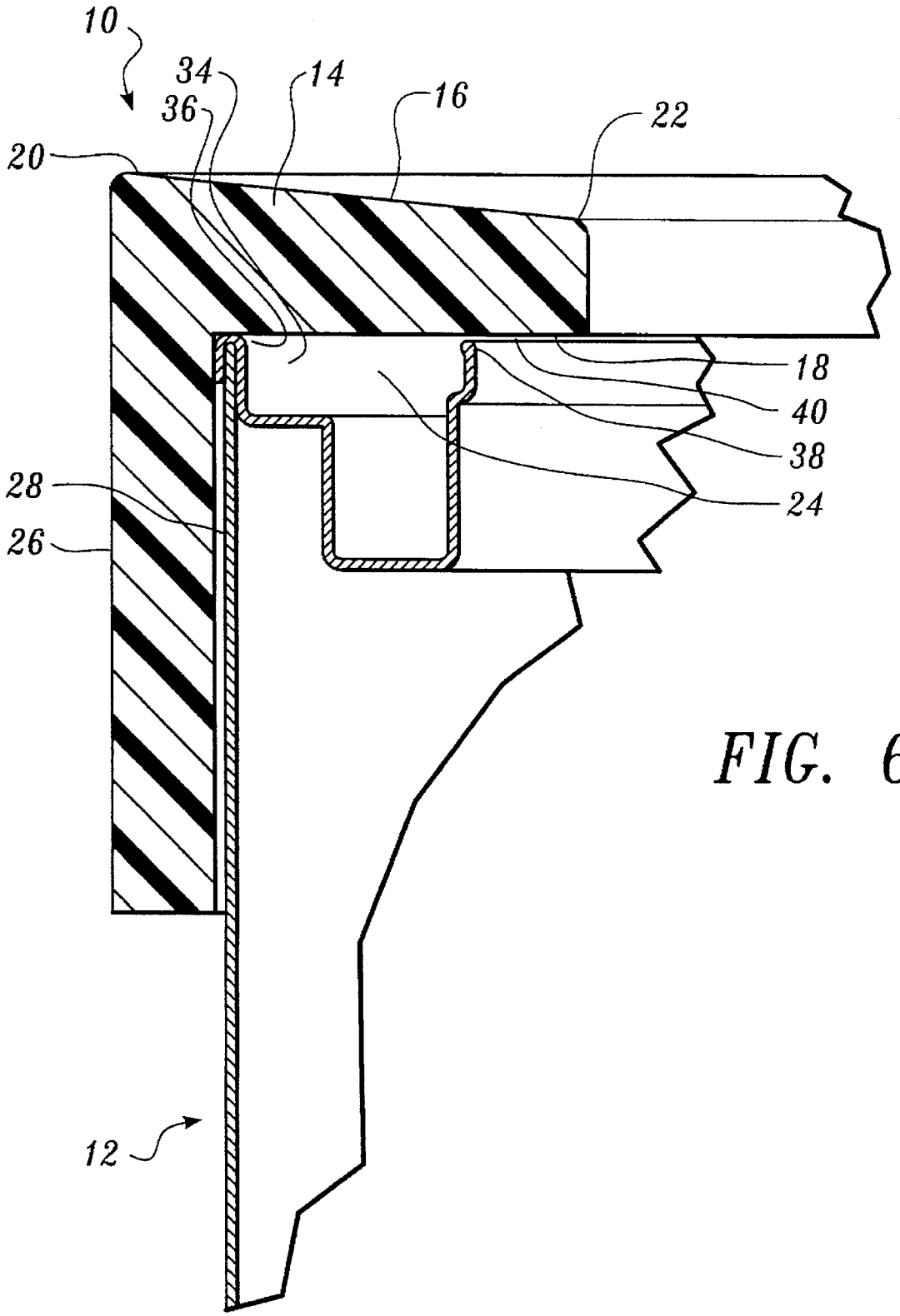
FIG. 6A is a cross-sectional view taken through line 6A—6A of FIG. 5 showing the paint can groove cover according to a first embodiment of the invention.
Figure 6B:
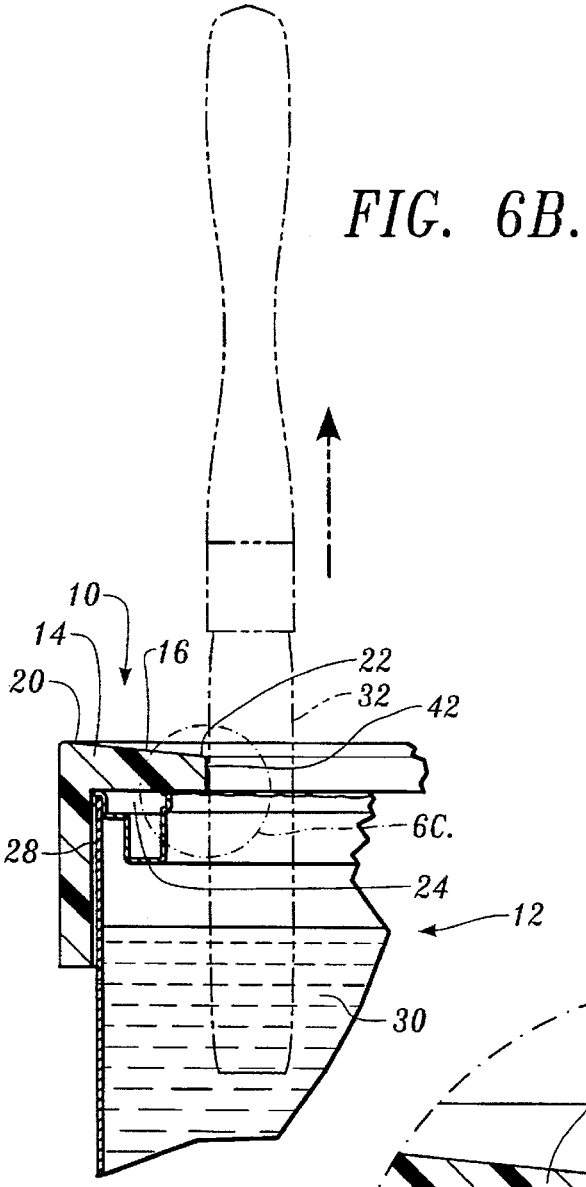
FIG. 6B is a cross-sectional view similar to FIG. 6A showing how a wetted paint brush is dipped directly into the paint can with the present paint can groove cover in place. The wetted paint brush is wiped off against the upper surface of the top portion or the inside vertical surface of the present device.

Referring now to the drawings in general and in particular to FIG. 1 of the drawings, there is shown a perspective view of the present invention as it is positioned over the top of a conventional paint can. This top portion of a paint can has a groove which engages the corresponding lip from a conventional paint can lid. In FIG. 1 the paint can groove cover of the present invention is shown generally by the number 10 as it is positioned over a conventional paint can shown generally by the number 12. In FIG. 1 it can be seen that the paint can groove cover 10 of the present invention has a top portion 14 with an upper surface 16 and a lower surface 18. The upper surface 16 of the top portion 14 is sloped downwardly slightly from its upper edge portion 20 toward its center edge portion 22 as seen most clearly in FIG. 6A. When in use, the conventional lid or cover 23 for the paint can is removed, and the present invention is slipped into place onto the rim area or top groove portion 24 of the paint can 12 also as seen in FIG. 6A. The lower surface 18 of the top portion 14 of the present paint can groove cover 10 is adapted to fit over the top groove portion 24 of the paint can 12. The paint can groove cover 10 of the present invention further comprises a side portion 26 which is adapted to engage the outside edge portion 28 of the paint can 12 and to extend longitudinally down the upper side portion 29 of the paint can 12. The side portion 26 of the paint can groove cover 10 extends longitudinally down the upper side portion 29 of the paint can 12 substantially to the handle carrying stud portion 31 of the paint can 12 as seen in FIGS. 1, 2, 6A and 6B. In the preferred embodiments of the present invention, the side portion 26 of the paint can groove cover 10 extends longitudinally down the upper side portion 29 of the paint can 12 at least one inch to substantially the stud portion 31 of the paint can 12 as opposed to snapping just over the outside edge portion 28 or outer rim of the paint can 10 in order to ensure that no paint will seep under the side portion 26 of the paint can groove cover 10 and get into the paint can groove portion 24 in that way. The elongated side portion 26 of the paint can groove cover 10 also serves to strengthen the integrity of the paint can groove cover 10 as the elongated side portion will not break or crack as a short snap-on side portion would be likely to do. In its simplest form and first embodiment, as shown in FIGS. 1, 6A, 6B, and 6C the present paint can groove cover 10 is used by the painter taking paint 30 by a wetted brush 32 directly from the can 12 with the paint can groove cover 10 in place. With the groove cover 10 in place, paint 30 can also be poured from the can into a roller tray or the like without paint or stain seeping under the cover 10 into the paint can groove portion 24. The slight downward sloping of the upper surface 16 of the top portion 14 of the groove cover 10 from its upper edge portion 20 toward its center edge portion 22 allows the brush 32 to be wiped on the upper surface 16 of the top portion 14 or the center edge portion 22 of the paint can groove cover 10 and allows the paint so then to return back into the can 12 without dripping over the outside edge portion 28 of the can 12, but does not prevent the paint 30 from being poured neatly from the paint can 12.

Figure 2:
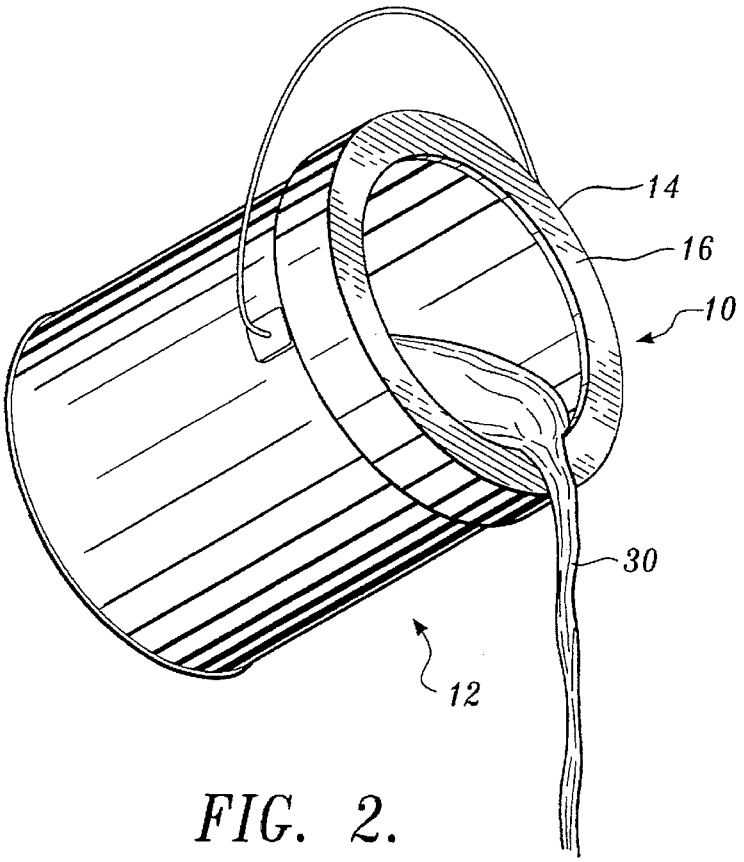
FIG. 2 is a perspective view of the present paint can groove cover showing the groove cover positioned on top of a resealable paint can with the existing paint can lid removed and the groove cover engaged while pouring paint from the can.

In FIG. 2 of the drawings there is shown a perspective view of the paint can groove cover of the present invention in its simplest form as seen in FIG. 1. In FIG. 2, paint so is being poured directly from the can 12 over the paint can groove cover 10, with the paint can groove cover 10 engaged on the top groove portion 24 of the paint can 12 as seen in FIG. 6A. Pouring from the paint can 12 in this manner allows the paint can groove portion 24 to be protected while at the same time allows pouring without removing the paint can groove cover 10 and without having an additional pour spout of any kind on the cover 10.

Figure 6C:
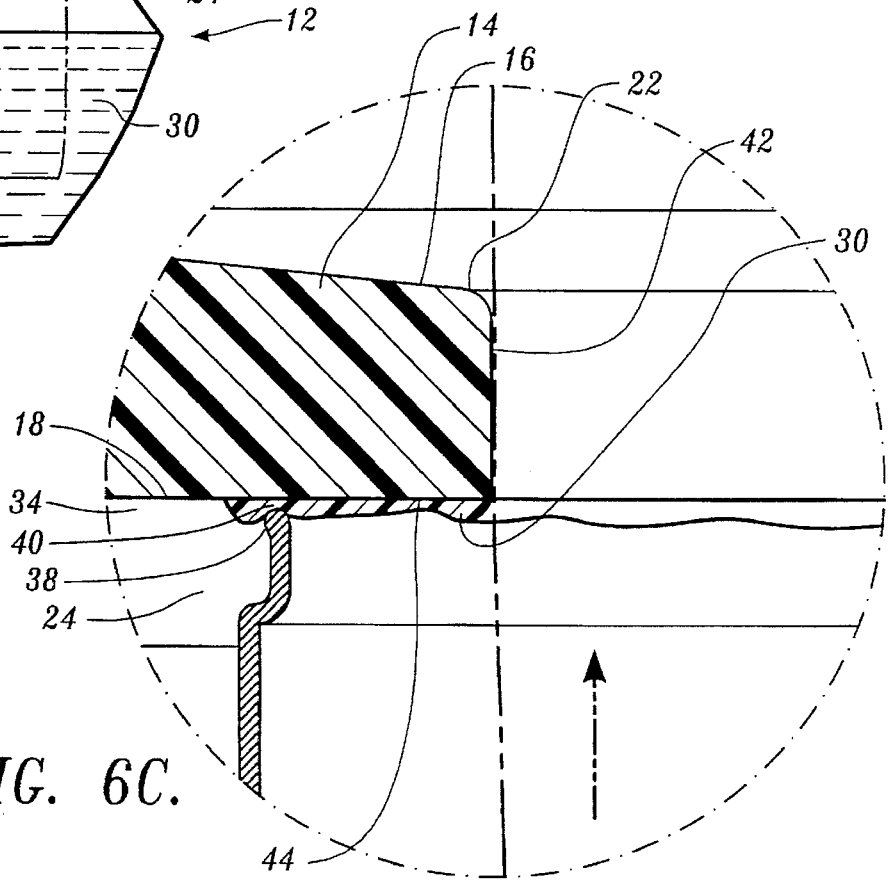
FIG. 6C is a cross-sectional view similar to FIG. 6A and 6B and enlarged showing how in most instances paint seals the gap between the lower surface of the top portion of the device and the sloping upper rim of the paint can.
Figure 7:
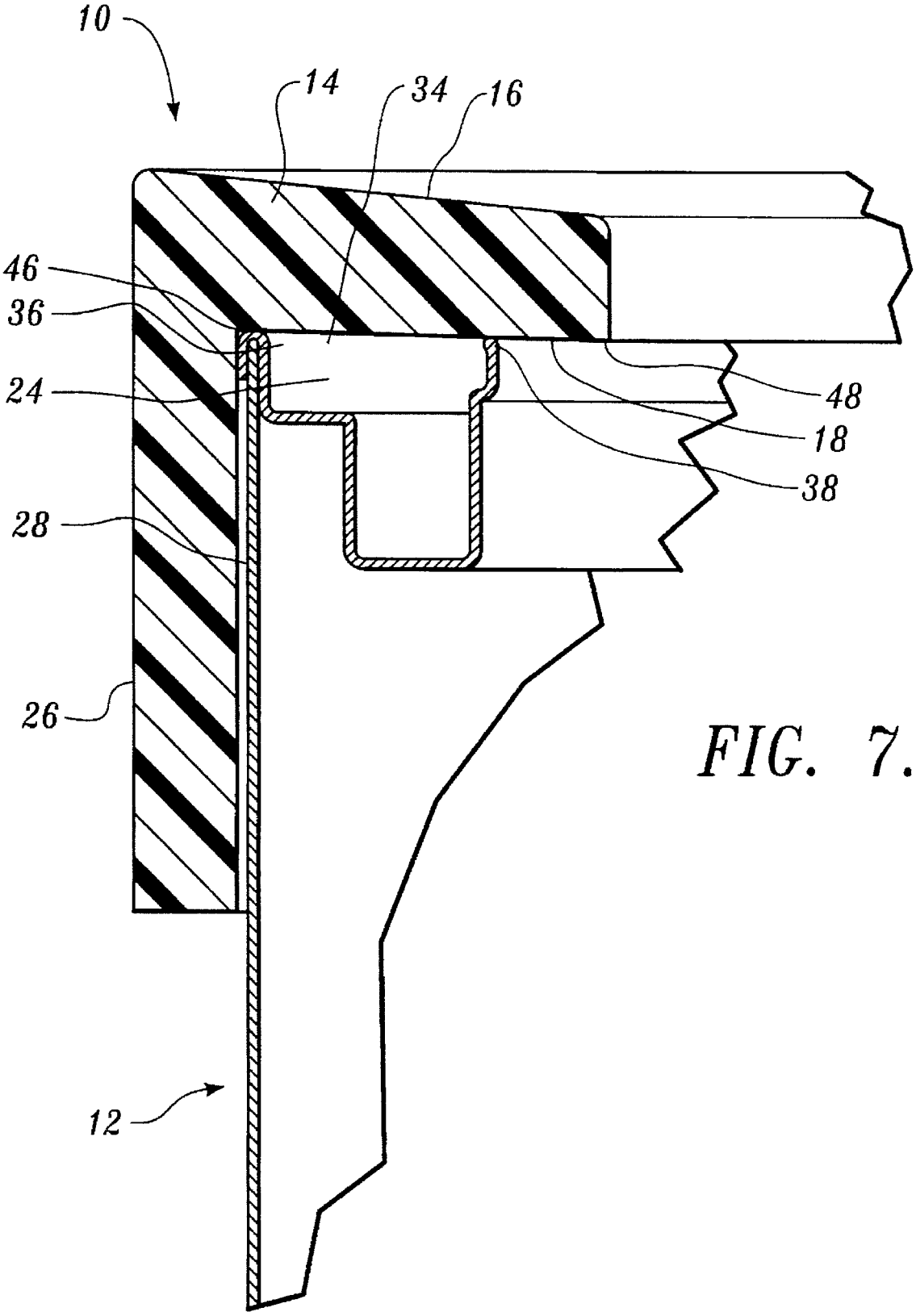
FIG. 7 is a cross-sectioned view taken through line 7—7 of FIG. 5 showing the paint can groove cover according to a second embodiment of the invention.
Figure 11:
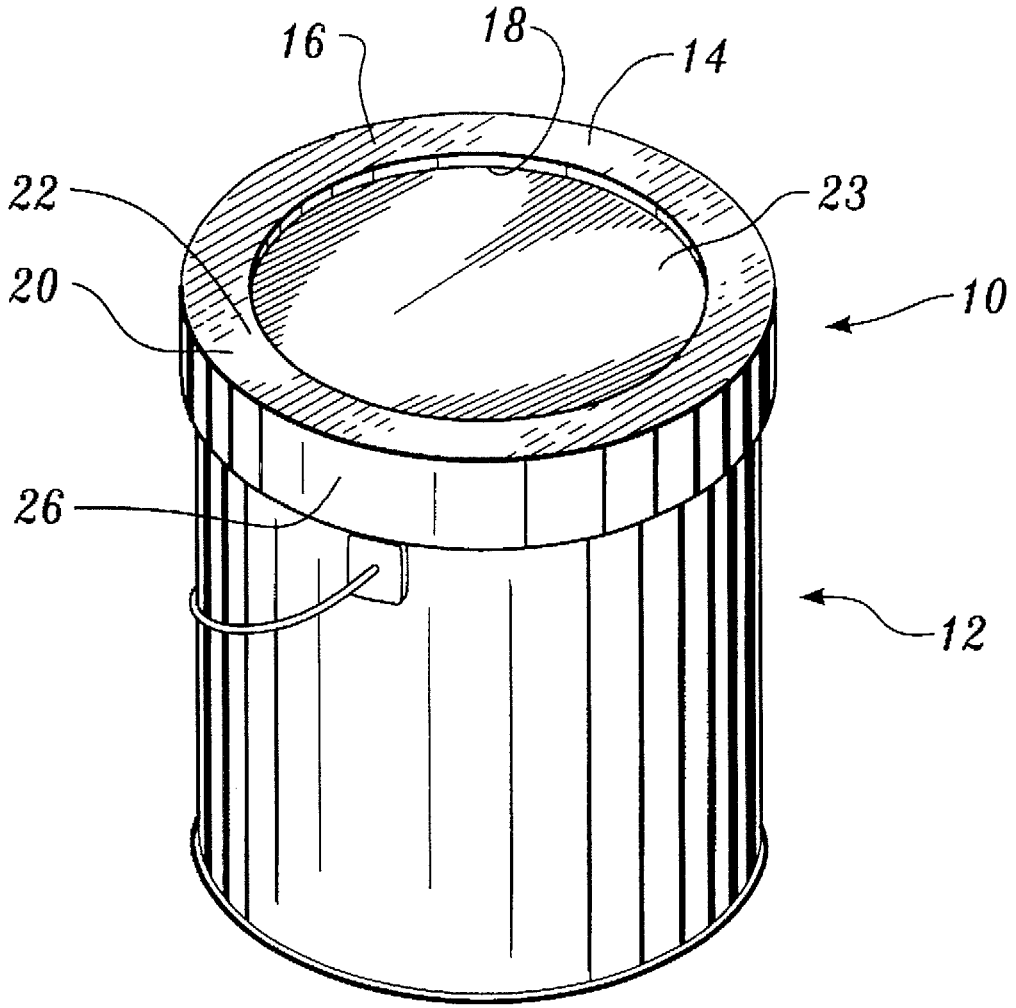
FIG. 11 is a perspective view of the present paint can groove cover shown as it is positioned on top of a resealable paint can with the existing paint can lid in place.

Generally, the top portion 14 of the paint can groove cover 10 of the present invention has a slightly sloped upper surface 16 to ensure that as paint 30 is wiped off on this upper surface 16 it will flow back into the paint can 12. The top portion 14 of the paint can groove cover 10 of the present invention has a generally flat lower surface 18 to allow the paint can groove cover 10 to he easily stored on the top groove portion 24 of a resealed paint can 12 with the can lid 23 in place, so that it is readily available for the next use as seen in FIGS. 6A and 11. Since the top edge portion 34 of a standard paint can 12 slopes slightly downward from its outside edge 36 to its inside edge 38 this generally flat lower surface 18 of the top portion 14 of the present invention presents a gap 40 between the lower surface 18 of the top portion 14 of the device and the inside edge 38 of the top edge portion 34 of the paint can 12 as seen most clearly in FIGS. 6A and 6C. In most cases, as the painter wipes the wetted brush, shown in phantom as number 32 in FIG. 6B, against the upper surface 16 of the top portion 14 and the center edge portion 22 of the paint can groove cover 10 and upwards against the inside vertical surface 42 of the paint can groove cover 10, paint 30 will be present on the middle edge portion 44 of the lower surface 18 of the paint can groove cover 10 as seen in FIG. 6C. Surface tension will then spread the paint 30 to the gap 40 where it will attach to the inside edge 38 of the top edge portion 34 of the paint can 12 and dry as seen most clearly in FIG. 6C. When the paint dries, it will form a thin film of paint 30 which will seal the thin gap 40 without the paint 30 going past the gap 40 and into the paint can groove portion 24 as shown most clearly in FIG. 6C. It is therefore unnecessary to wash the paint can groove cover 10 after use and indeed, the dried paint serves to improve the effectiveness of the paint can groove cover 10. It is, also however, within the spirit and scope of the present invention to slope the lower surface 18 of the top portion 14 of the paint can groove cover 10 downwardly from its outside edge 46 to its inside edge 48 in a manner to complement the sloping top groove portion 24 of a standard paint can 12 as seen in FIG. 7 in a second embodiment of the present invention. Sloping the lower surface 18 of the top portion 14 of the paint can groove cover 10 in such a manner as seen in FIG. 7, would eliminate the gap 40 formed between the lower surface 18 of the top portion 14 of the device and the inside edge 38 of the paint can 12, thereby reducing the need for a sealing means to seal the gap 40 between the lower surface 18 of the top portion 14 of the device 10 and the inside edge 38 of the top edge portion 34 of the paint can 12. However, with the lower surface 18 of the top portion 14 of the paint can groove cover 10 sloped downwardly from its outside edge 46 to its inside edge 48 and toward the inside edge 38 of the paint can 12, the paint can groove cover 10 of the present invention would not fit easily over the top of a resealed paint can thereby making storage of the device 10 on top of a re-sealed paint can impossible.

Figure 3:
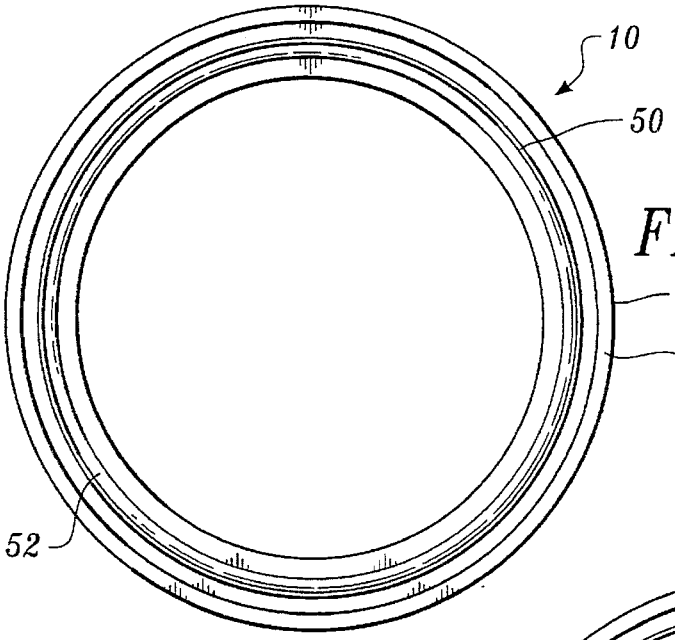
FIG. 3 is a bottom plan view of the present paint can groove cover according to one of the preferred embodiments of the invention.
Figure 8:
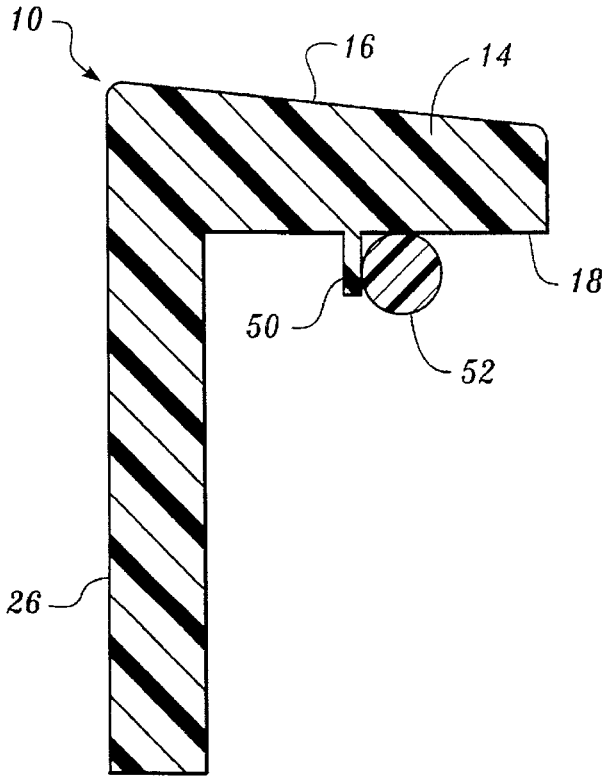
FIG. 8 is a cross-sectional view taken through line 8—8 of FIG. 5 showing the paint can groove cover where a whole gasket is pressed into the paint can groove according to a third embodiment of the invention.
Figure 9:
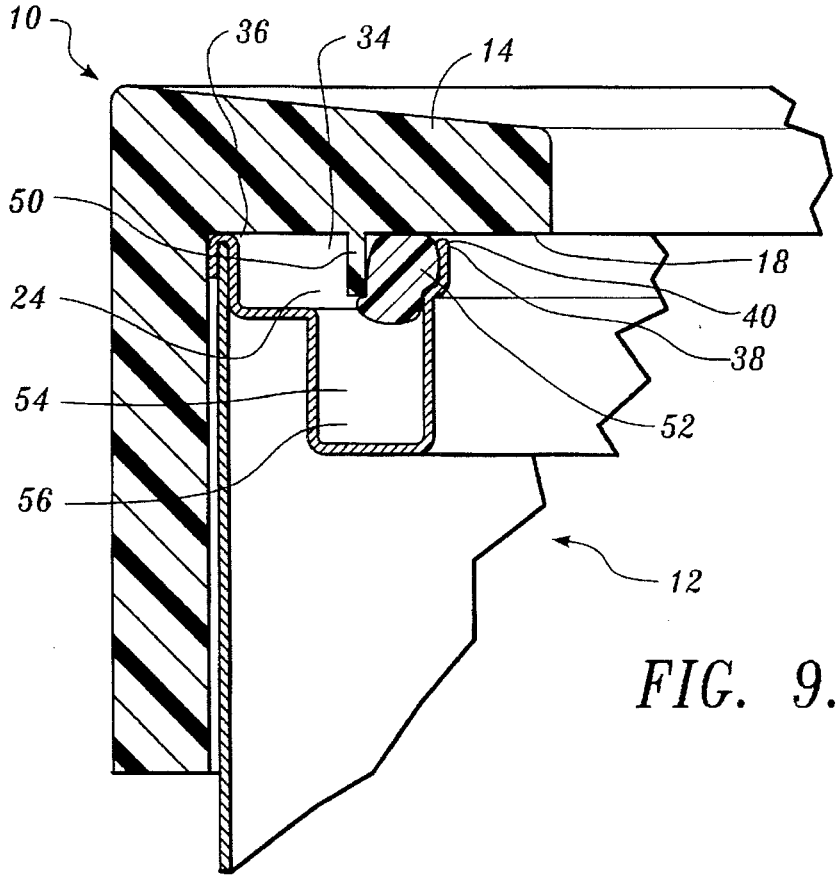
FIG. 9 is a cross-sectional view taken through line 9—9 of FIG. 5, similar to FIG. 8 showing how the annular ridge of the present invention serves to press the whole or partial gasket into the paint can groove. Where a partial gasket is pressed into the paint can groove it is according to a fourth embodiment of the present invention.

FIG. 3 is a bottom plan view of the present paint can groove cover according to a third embodiment of the invention. In FIG. 3 it can be seen that an annular ridge 50 which is integral with the body of the paint can groove cover 10 has been added to the lower surface 18 of the top portion 14 of the paint can groove cover 10. The annular ridge 50 encircles the entire circumference of the lower surface 18 of the top portion 14 of the groove cover 10. In the third embodiment as shown in FIG. 3 and FIG. 8, a gasket 52 has been inserted into the annular path 54 of the groove 56 in the top groove portion 24 of the paint can 12 as seen in FIG. 9. In the third embodiment as shown in FIGS. 3 and 8, the annular ridge 50 serves as a pressing means to press the full length gasket 52 into the annular path 54 of the groove 56 in the top portion 24 of the paint can 12. In this way, the gap 40 formed between the lower surface 18 of the paint can groove cover 10 and the inside edge 38 of the top edge portion 3 of the paint can 12 is sealed to ensure that no liquid will seep under the lower surface 18 of the top portion 14 of the groove cover 10 and into the top groove portion 24 of the paint can 12 as seen in FIG. 9. In the third embodiment as shown in FIGS. 3 and 8, when the device 10 is pressed down onto the top edge portion 34 of the paint can 12 and the whole gasket 52, is positioned in the annular path 54 of the paint can groove 56, the annular ridge 50 serves as a pressing means to press against the whole gasket 52 thereby deforming the gasket 52 and effectively sealing the gap 40 between the lower surface 18 of the paint can groove cover 10 and the inside edge 38 of the top edge portion 34 of the paint can 12 as seen most clearly in FIG. 9. The gasket 52 therefore stays in place in the annular path 54 of the paint can groove 56 when the paint can groove cover 10 is removed and the paint can groove 56 remains effectively sealed with the gasket 52 in place and the paint can groove cover 10 removed. In the third embodiment as shown in FIG. 3 and FIG. 8 then, paint 30 may be poured out of the can 12 with the paint can groove cover 10 in place and the gasket 52 in position under the cover 10 and within the groove 56; or with the paint can groove cover 10 removed and only the whole gasket 52 in place. Either way, the annular path 54 of the groove 56 in the paint can 12 is protected. This third embodiment of the present invention may be used to further ensure that no paint seeps into the paint can groove portion 24 of the paint can 12 when thicker liquids are used such as paints, as opposed to the thinner liquids such as stains which are sufficiently kept out of the paint can groove 56 in the first embodiment of the present invention.

Figure 4:
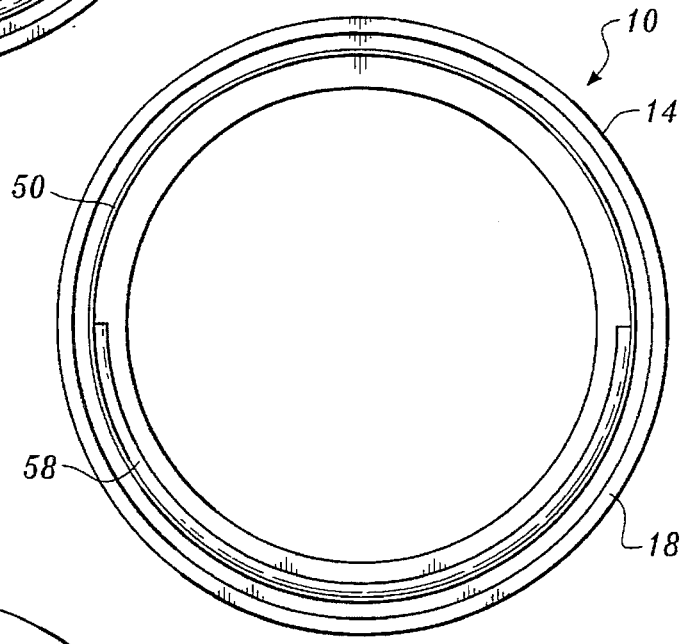
FIG. 4 is a bottom plan view of the present paint can groove cover according to another of the preferred embodiments of the invention.
Figure 5:
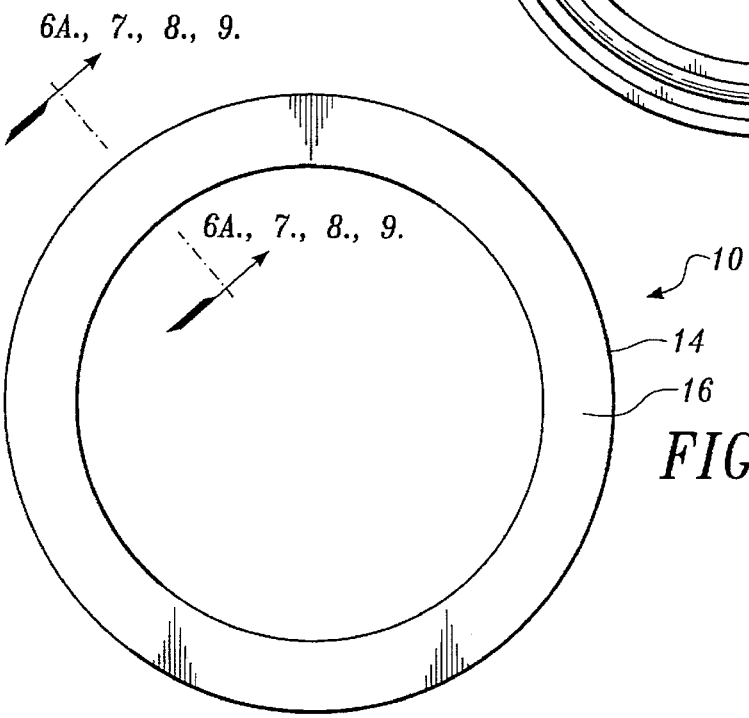
FIG. 5 is a top plan view of the present paint can groove cover. The top plan view of the present invention is the same for all the preferred embodiments.

FIG. 4 is a bottom plan view of the present paint can groove cover according to a fourth embodiment of the present invention. In the fourth embodiment of the present invention as shown in FIG. 4, there is shown the same annular ridge 50 of FIG. 3, the annular ridge 50 being integral with the paint can groove cover 10 and encircling the entire circumference of the lower surface 18 of the top portion 14 of the paint can groove cover 10. In FIGS. 4 and 11, a partial gasket 58 has been inserted into the annular path 54 of the groove 56 in the top groove portion 24 of the paint can 12 in a manner similar to that described with reference to FIGS. 3, 8 and 9. In the fourth embodiment as shown in FIG. 4 the annular ridge 50 also serves as a pressing means to press the substantially half length gasket 58 into the annular path 54 of the groove 56 in the top groove portion 24 of the paint can 12 as seen in FIG. 9. In the fourth embodiment of FIG. 4 also, the gap 40 formed between the lower surface 18 of the paint can groove cover 10 and the inside edge 38 of the top edge portion 34 of the can 12 is sealed to ensure that no liquid will seep under the lower surface 18 of the top portion 14 of the groove cover 10 and into the top groove portion 24 of the paint can 12 as seen most clearly in FIG. 9. In the fourth embodiment as shown in FIG. 4, when the device 10 is pressed down onto the partial gasket 58, the annular ridge 50 will also serve as a pressing means to press against the partial gasket 58 thereby deforming the partial gasket 58 and effectively sealing the gap 40 between the lower surface 18 of the paint can groove cover 10 and the inside edge 38 of the top edge portion 34 wherever the partial gasket 58 is in place in the annular path 54 of the paint can groove 56 as seen in FIG. 9. The whole gasket 52 of the third embodiment shown in FIG. 9 would also be the partial gasket 58 of the fourth embodiment if the partial gasket 58 is positioned under the paint can groove cover 10 in that portion of the paint can groove 56 shown in the cross section of FIG. 9. In the fourth embodiment as shown in FIG. 4, paint 30 may be poured out of the can 12 with the device 10 in place, over the portion of the device 10 that has the partial gasket 58 in place under the cover 10 and within the groove 56, or with the paint can groove cover 10 removed and the partial gasket 58 only in place in the annular path 54 of the paint can groove 56 as seen in FIG. 9. In either the third of fourth embodiment as shown in FIGS. 3, 4, 8 and 9 the gasket, either partial or whole, serves to allow paint to be poured from the can 12 with the paint can groove cover 10 in place and the whole or partial gasket underneath the cover 10 within the groove portion 24 on the top of the can 12; or with the cover 10 removed with only the gasket in place within the groove portion 24 of the paint can 12.

Figure 10:
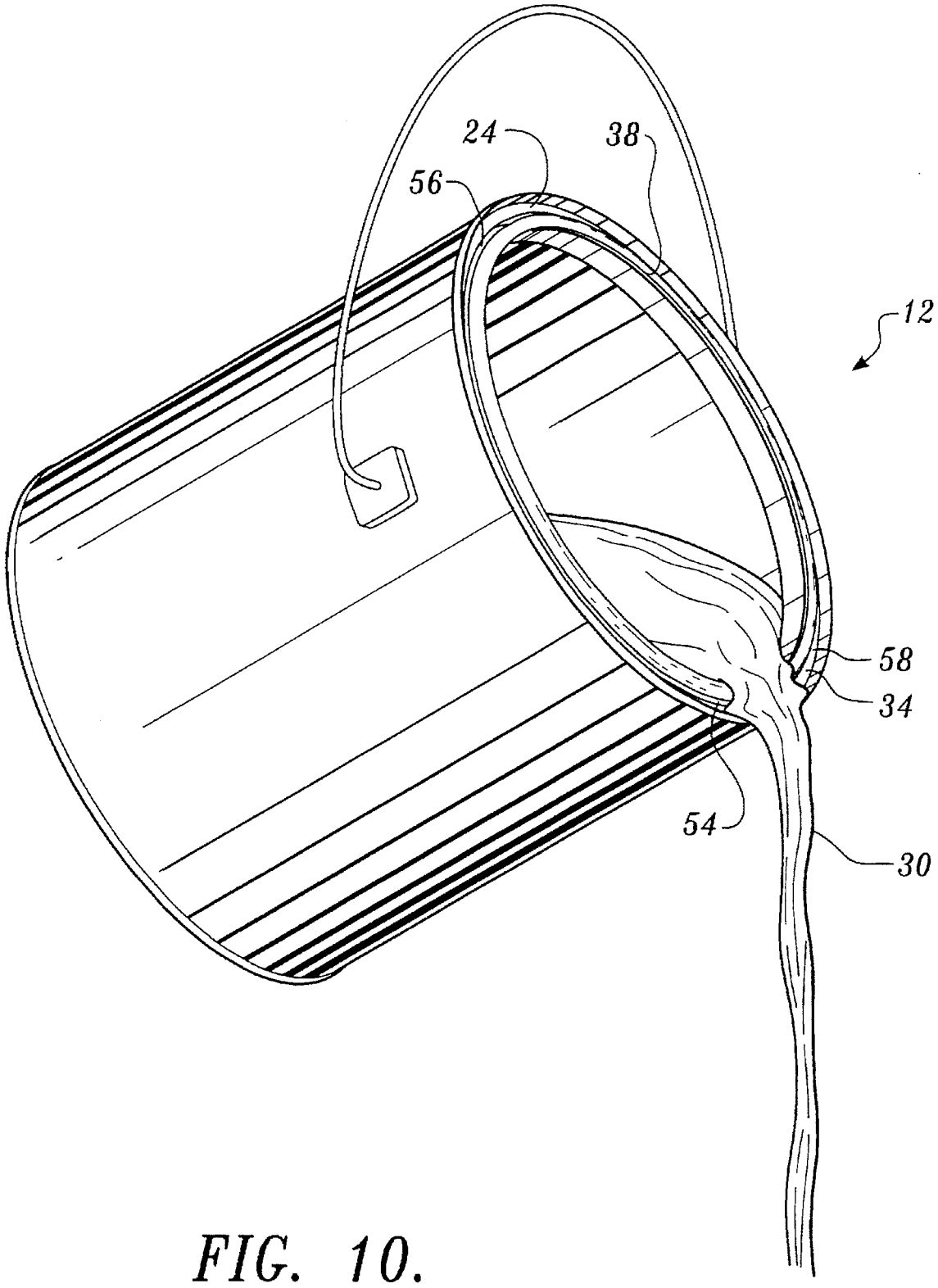
FIG. 10 is a perspective view of the present invention cover showing the groove cover removed and the gasket of the groove cover only positioned in the groove while pouring paint from the can.

In practice, then, the whole 52 or partial gasket 58 is loosely placed over the general area of the paint can groove portion 24. The paint can groove cover 10 is placed over the paint can groove 56 and the annular ridge 50 of the lower surface 18 of the paint can groove cover 10 serves to press the gasket 52 or 58 tightly into the paint can groove 56 so that when the cover 10 is removed the gasket 52 or 58 will remain by itself snugly in the paint can groove 56. With the gasket 52 or 58 only snugly in place in the paint can groove 56, paint can be poured from the can 12 across the gasket 52 or 58 with no paint seeping into the groove 56 as seen most clearly in FIG. 10. As paint covers the gasket 52 or 58, preferably made of cording or other suitable flexible material, the gasket 52 or 58 will harden as the paint on it dries. This serves to form the gasket 52 or 58 into the shape of the paint can groove 56 so that it is easily re-used on another paint can 12 of the same size. Thus, it can be seen that paint can be poured easily from the paint can 12 with the paint can groove cover 10 in place with the gasket 52 or 58 underneath or with the paint can groove cover 10 removed and only the gasket 52 or 58 in place to protect the paint can groove 56.

In both the third and fourth embodiments of the present invention, the whole gasket 52 or the partial gasket 58 are made of simple household cording such as is used to draw up window blinds, however, the use of any suitable material to accomplish the sealing purpose of the gasket 52 is within the spirit and scope of the invention. In the first and second embodiments of the present invention, where no annular ridge 50 has been added to the lower surface 18 of the top portion 14 of the paint can groove 10, the paint can groove cover 10 is preferably made from a mold of polyethylene. In the third and fourth embodiments of the present invention, where an annular ridge 50 is added to the lower surface 18 of the top portion 14 of the paint can groove cover 10 to serve as a pressing means for pressing the whole gasket 52 or the partial gasket 58 into the paint can groove 56, the annular ridge 50 is integral with the body of the paint can groove cover 10 and can easily and inexpensively be formed by changing the mold slightly and again using polyethylene in the mold. It is however, within the spirit and scope of the invention to form the paint can groove cover 10 with or without the annular ridge 50 from any suitable material.

From the foregoing it can be seen that the applicant's invention provides a paint can groove cover that is simple and inexpensive to use which allows paint to be poured from a paint can with the groove cover in place with minimal or no paint seeping into the paint can groove. Other embodiments allow paint to be poured from the can with the cover removed while still protecting the paint can groove. There has been accomplished by the applicant's invention all of the objects and advantages of the invention. Nevertheless, variation in the structure of the invention and the arrangement of the various parts are within the spirit and scope of applicant's invention. The embodiments given have been given only by way of illustration and the applicant is not to be limited to the embodiments shown and described.

Having described my invention, I claim:

1. A paint can groove cover for use on a paint can, the paint can having a top groove portion with a groove and an annular groove path, a lid, and an upper side portion, the paint can groove cover comprising:

a flexible annular ring having a top portion with a first upper surface and a second lower surface, the first upper surface of the top portion having an outside edge and an inside edge, the first upper surface of the top portion being sloped downwardly from its outside edge to its inside edge; and a side portion to engage the upper side portion of the paint can;

a sealing means adapted to fit around at least a portion of the annular path of the top groove portion of the paint can;

a pressing means integral with and encircling the circumference of the second lower surface of the top portion of the annular ring, the pressing means adapted to press the sealing means into the groove portion of the can, wherein the pressing means is an annular ridge which is integral with and encircles the circumference of the second lower surface of the top portion of the annular ring; and whereby paint is poured out of the paint can with the paint can lid removed and with the paint can groove cover engaged over the top groove portion of the paint can; and whereby paint is poured out of the paint can with the paint can groove cover removed and the sealing means engaged in the groove portion of the paint can.

2. The paint can groove cover as defined in claim 1 wherein:

the sealing means is a flexible gasket adapted to fit around the entire annular path of the top groove portion of the paint can to further ensure no paint seepage into the paint can groove.

3. The paint can groove cover as defined in claim 1 wherein:

the sealing means is a flexible gasket adapted to fit around a partial portion of the annular path of the top groove portion of the paint can to further ensure no paint seepage into the paint can groove; and whereby paint is poured from the can across a partial portion of the annular ring having the gasket engaged in the partial portion of the annular path of the top groove portion of the paint can.

4. The paint can groove cover as defined in claim 3 wherein the gasket fits around substantially one-half of the annular path of the top groove portion of the paint can.

5. The paint can groove cover as defined in claim 1 wherein the annular ring is made of polyethylene.

6. The paint can groove cover as defined in claim 1 wherein the annular ring and annular ridge are integrally formed in one piece of polyethylene.

7. The paint can groove cover as defined in claim 2 wherein the gasket is made of cording.

8. A paint can groove cover for use on a paint can, the paint can having a top groove portion with an outside edge, a groove and an annular groove path, a lid, and an upper side portion, the paint can groove cover comprising:

a flexible annular ring having a top portion with a first end having a single side portion extending therefrom and a second open end, the top portion having an outside edge adapted to fit directly over the outside edge of the paint can, the top portion having a first upper surface and a second lower surface, the first upper surface of the top portion having an outside edge portion on its first end and an inside edge portion on its second open end, the first upper surface of the top portion being sloped downwardly a length from its outside edge portion to its inside edge portion; the single side portion engaging the Upper side portion of the paint can and extending downwardly from the first end of the top portion a length that is greater than the length of the top portion;

a sealing means having two sides adapted to fit around at least a portion of the annular path of the top groove portion of the paint can;

a pressing means integral With and encircling the circumference of the second lower surface of the top portion of the annular ring, the pressing means adapted to press a single side of the sealing means into the groove portion of the can, wherein the pressing means is an annular ridge which is integral with and encircles the circumference of the second lower surface of the top portion of the annular ring; and whereby paint is poured out of the paint can with the paint can groove cover engaged over the top groove portion of the paint can with minimal paint seeping into the paint can groove and whereby with the paint can lid engaged the paint can groove cover can be stored atop the lid.

9. The paint can groove cover as defined in claim 8 wherein:

the sealing means is a flexible gasket adapted to fit around the entire annular path of the top groove portion of the paint can to further ensure no paint seepage into the paint can groove.

10. The paint can groove cover as defined in claim 8 wherein:

the sealing means is a flexible gasket adapted to fit around a partial portion of the annular path of the top groove portion of the paint can to further ensure no paint seepage into the paint can groove; and whereby paint is poured from the can across a partial portion of the annular ring having the gasket engaged in the partial portion of the annular path of the top groove portion of the paint can.

11. The paint can groove cover as defined in claim 10 wherein the gasket fits around substantially one-half of the annular path of the top groove portion of the paint can.

12. The paint can groove cover as defined in claim 8 wherein the annular ring is made of polyethylene.

13. The paint can groove cover as defined in claim 8 wherein the annular ring and annular ridge are integrally formed in one piece of polyethylene.

14. The paint can groove cover as defined in claim 11 wherein the gasket is made of cording.

* * * * *